United States Patent [19]

Drewitz et al.

[11] Patent Number: 4,486,004

[45] Date of Patent: Dec. 4, 1984

[54] JACK STAND

[76] Inventors: Arthur O. Drewitz, Box 111, Assiniboia, Saskatchewan, Canada, S0H 0B0; Donald D. Bushell, General Delivery, Limerick, Saskatchewan, Canada, S0H 2P0

[21] Appl. No.: 452,336

[22] Filed: Dec. 22, 1982

[30] Foreign Application Priority Data

Dec. 24, 1981 [CA] Canada ..... 393226

[51] Int. Cl.[3] ..... B66F 3/00

[52] U.S. Cl. ..... 254/2 B; 254/DIG. 1

[58] Field of Search ..... 254/2 R, 2 B, 2 C, 133, 254/134, DIG. 1, 100, 1; 269/17

[56] References Cited

U.S. PATENT DOCUMENTS

| | | | |
|---|---|---|---|
| 1,350,970 | 8/1920 | Hutchison et al. | 254/DIG. 1 |
| 2,669,424 | 2/1954 | Branick | 254/2 B |
| 3,073,570 | 1/1963 | Harvey | 254/134 |

*Primary Examiner*—Robert C. Watson

*Attorney, Agent, or Firm*—Stanley G. Ade

[57] ABSTRACT

Relatively tall jacks which include a small base plate and an elongated vertical post are unstable under many operating conditions due to the height of the stem and the relatively small base provided. The present device is a stand adapted to receive such jacks and to provide a relatively safe support thereto. The jack stand includes a rectangular base with stabilizing pans extending outwardly therefrom and a pair of wheels which engage the ground when the jack stand is tipped so that it can be maneuvered into position. A pair of vertical supports extend upwardly from the stand surmounted by an apertured brace through which the jack stand extends and is retained. The base of the jack is detachably secured to the base of the stand. A handle is provided at the upper ends of the support for maneuvering the jack and stand upon the two wheels and a bale detachably supports the actuating handle of the jack against the stem when not in use.

26 Claims, 4 Drawing Figures

JACK STAND

BACKGROUND OF THE INVENTION

This invention relates to new and useful improvements in jack stands designed primarily for use with jacks such as the "Jackall" (trade mark). Such jacks include a relatively small rectangular base and a relatively long elongated vertically situated stem upon which the jacking element is moved upwardly and downwardly by means of an actuating handle. While relatively stable when the jacking element is adjacent the base of the stem, they become increasingly unstable as the jacking element moves towards the upper end of the jack stem.

SUMMARY OF THE INVENTION

The present invention overcomes these disadvantages by providing a jack stand into which such a jack may be detachably secured thus adding stability to such jacks particularly when the jacking element is adjacent the upper end thereof.

In accordance with the invention there is provided a jack stand for jacks which includes a base plate and a relatively long vertically extending jack stem, and an actuating handle for a jacking element movable up and down the stem; said jack stand comprising in combination a supporting base, means to stabilize said base, a pair of spaced and parallel support posts extending upwardly from said supporting base, an apertured top brace plate for detachably receiving the upper end portion of the stem of the associated jack and means to detachably clamp the base plate of the associated jack, to the supporting base.

Another advantage of the present invention is that the jack and stand are easily moved from one location to the other due to a pair of wheels which engage the ground when the stand and the associated jack are tipped from the vertical.

Another advantage of the invention is to provide a device of the character herewithin described which is suitable for use with existing jacks and is readily adapted for engagement thereby.

A yet further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indcate corresponding parts in the different figures.

DETAILED DESCRIPTION

Figure 4:
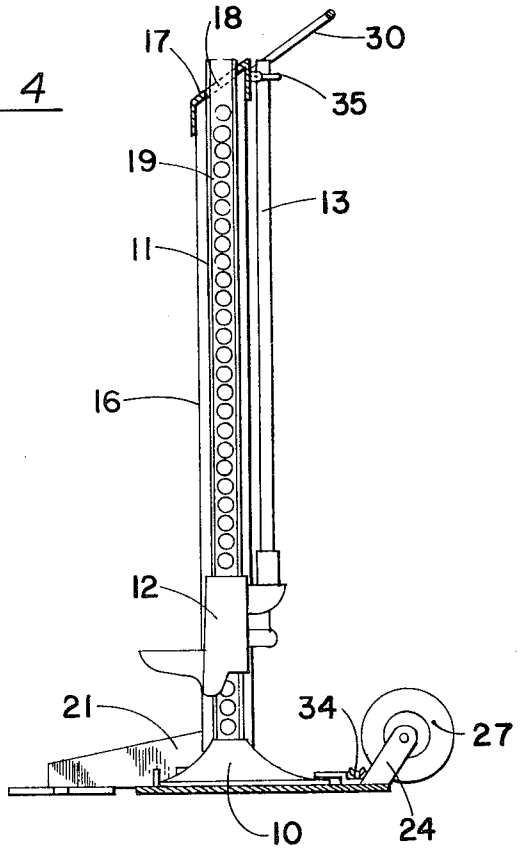
FIG. 4 is a view similar to FIG. 2 but with one post removed to show a jack in position.

Proceeding therefore to describe the invention in detail reference should first be made to FIG. 4 which shows a conventional jack including a relatively small base 10, a jack stem 11 extending upwardly therefrom, a jacking element 12 movable up and down the stem and the actuating handle 13 operatively connected to the stem for moving same up and down. Such jacks are manufactured under the trade mark "Jackall" although other manufacturers produce similar jacks. They all suffer from the disadvantage of relative instability particularly under circumstances in which the vehicle or the like being elevated, is difficult to engage with the jack. Such instability is well known.

Figure 2:
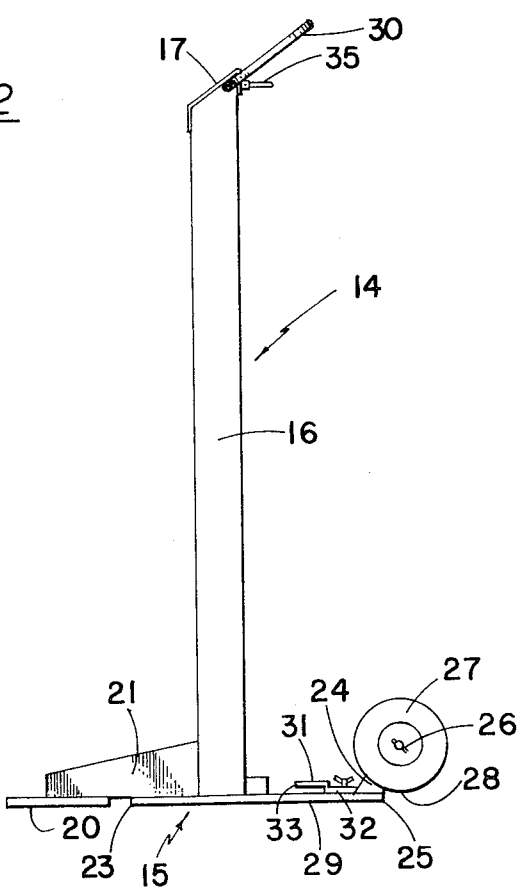
FIG. 2 is a side elevation thereof.

The invention collectively designated 14 consists of a supporting base collectively designated 15, a pair of spaced and parallel vertically extending supporting posts 16 extending upwardly from the supporting base 15 and a top brace plate 17 secured to and spanning the upper ends of the posts 16 and maintaining same in the spaced and parallel vertical relationship. Reference to FIG. 2 will show that this top brace plate 17 is situated at an angle from the vertical and that it is apertured as at 18 to detachably receive the upper end portion 19 of the stem 11 of the jack engaging the jack stand. The sloping relationship of the brace plate 17 facilitates the engagement and disengagement of the stem 19 in order that the jack may be positioned in the stand as will hereinafter be described.

Figure 3:
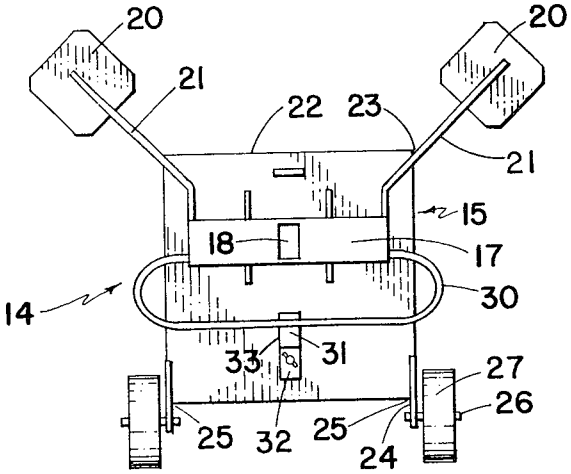
FIG. 3 is a top plan view thereof.

Means are provided to stabilize the substantially rectangular supporting base 15, said means taking the form of a pair of pads 20 mounted upon members 21 which in turn are welded to the upper side of the supporting base 15. These members 21 are situated adjacent one side 22 of the supporting base and diverge outwardly and away from the corners 23 as clearly shown in FIG. 3. The pads, which are welded to the distal end of the members or brackets 21 therefore are situtated spaced away from these corners and provide stability to the supporting base, it being understood that they lie substantially in the same plain as the supporting base as clearly shown in FIG. 1.

Brackets 24 are secured as by welding to adjacent the other corners 25 of the rectangular supporting base 15 and extend upwardly and away from the supporting base. These brackets support axles 26 upon which wheels 27 are journalled for rotation and it will be observed that the lower peripheries of the wheels 27 are situated just above the lower surface 29 of the base 15 when the base is situated upon a supporting surface in a horizontal position together with pads 20 also engaging the supporting surface.

Figure 1:
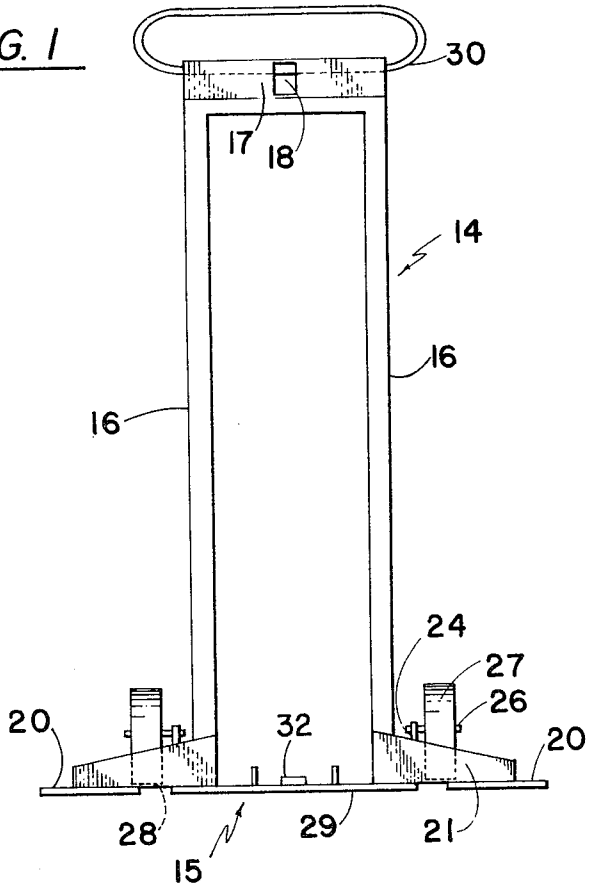
FIG. 1 is a front elevation of the jack stand per se.

A handle 30 extends from one side of the top brace 17 and is in the form of a flattened loop as clearly shown in FIG. 1. It extends from the vertical posts 16 on the same side as the wheels 27 so that the stand together with jack engaged therewith, can readily be tipped onto the wheels and maneuvered from one location to the other.

Means are provided to detachably secure the base 10 of the jack onto the supporting base 15, said means taking the form of a clamping bracket 31 one end of which is freely engageable within a retainer bracket 32 secured to the supporting base and the other end 33 of which overlaps the edge of the base 10 of the jack. Once engaged, a clamp screw 34 pulls the clamp bracket 31 downwardly into engagement with the base 10 and clamps it firmly in position.

It will be noted that the inner ends of the brackets 21 supporting pads 20 are preferably welded to the lower ends of the support post 16 to stabilize same.

In operation, the jack stem 19 is tilted from the side upon which wheels 27 are located thus facilitating the engagement of the upper end portion 19 through the aperture 18 within the top brace plate 17 whereupon the base 10 of the jack together with the element 12 are pivoted downwardly onto the supporting base 15 so that the jack is situated vertically between the posts 16 as clearly shown in FIG. 4.

The bracket 31 is then engaged over the edge of the base 10 and the clamp screw 34 is tightened thus retaining the jack firmly in position upon the support stand.

The actuating handle 13 can then be operated in the usual manner with the pads 20 together with the relatively large supporting base 15 providing stability to the jacking operation.

When being stored, the operating handle 13 is moved to the vertical position against the jack stem 11 whereupon the small bale 35, which is pivoted to the side of the top brace plate 17, is swung downwardly over the upper end of the handle 13 thus detachably retaining it in this stored position. It will be observed that the handle 13 and the bale 35 are on the same side of the vertical post as the handle 30 and wheels 27.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A jack stand for jacks which include a base plate and a relatively long vertically extending jack stem, and an actuating handle for a jacking element movable up and down the stem; said jack stand comprising in combination a supporting base, means to stabilize said base, a pair of spaced and parallel support posts extending upwardly from said supporting base, an apertured top brace plate for detachably receiving the upper end portion of the stem of the associated jack and means to detachably clamp the base plate of the associated jack, to the supporting base, said apertured top brace plate being situated at an angle to the vertical to facilitate detachable engagement of the stem of the associated jack, through said aperture.

2. The jack stand according to claim 1 in which said supporting base is substantially rectangular when viewed in plan and includes a pair of wheels secured to adjacent a pair of adjacent corners of said support base, the axis of said wheels being spaced above said supporting base, with the periphery of the wheels being just above the underside of the supporting base.

3. The jack stand according to claim 2 which includes means to support said wheels for rotation, said means including a wheel support bracket secured by one end thereof to said supporting base and extending upwardly and outwardly therefrom.

4. The jack stand according to claim 1 in which said means to stabilize said supporting base includes a pair of support pads and means mounting said pads one upon each side of said supporting base and adjacent one end thereof, said last mentioned means extending diagonally outwardly from adjacent corners of one end thereby spacing said support pads outwardly and away from said supporting base, said pads lying substantially in the same plane as said support base.

5. The jack stand according to claim 2 in which said means to stabilize said supporting base includes a pair of support pads and means mounting said pads one upon each side of said supporting base and adjacent one end thereof, said last mentioned means extending diagonally outwardly from adjacent corners of one end thereby spacing said support pads outwardly and away from said supporting base, said pads lying substantially in the same plane as said support base.

6. The jack stand according to claim 3 in which said means to stabilize said supporting base includes a pair of support pads and means mounting said pads one upon each side of said supporting base and adjacent one end thereof, said last mentioned means extending diagonally outwardly from adjacent corners of one end thereby spacing said support pads outwardly and away from said supporting base, said pads lying substantially in the same plane as said support base.

7. The jack stand according to claim 1 in which said means to detachably clamp the base plate on the associated jack to the supporting base includes a loose clamp bracket engaging over the base of the associated jack and being detachably secured to said supporting base and clamp means for clamping said clamp bracket to said supporting base.

8. The jack stand according to claim 2 in which said means to detachably clamp the base plate of the associated jack to the supporting base includes a loose clamp bracket engaging over the base of the associated jack and being detachably secured to said supporting base and clamp means for clamping said clamp bracket to said supporting base.

9. The jack stand according to claim 3 in which said means to detachably clamp the base plate of the associated jack to the supporting base includes a loose clamp bracket engaging over the base of the associated jack and being detachably secured to said supporting base and clamp means for clamping said clamp bracket to said supporting base.

10. The jack stand according to claim 4 in which said means to detachably clamp the base plate of the associated jack to the supporting base includes a loose clamp bracket engaging over the base of the associated jack and being detachably secured to said supporting base and clamp means for clamping said clamp bracket to said supporting base.

11. The jack stand according to claim 5 in which said means to detachably clamp the base plate of the associated jack to the supporting base includes a loose clamp bracket engaging over the base of the associated jack and being detachably secured to said supporting base and clamp means for clamping said clamp bracket to said supporting base.

12. The jack stand according to claim 6 in which said means to detachably clamp the base plate of the associated jack to the supporting base includes a loose clamp bracket engaging over the base of the associated jack and being detachably secured to said supporting base and clamp means for clamping said clamp bracket to said supporting base.

13. The jack stand according to claim 1 which includes a handle extending from adjacent the upper ends of said vertical support posts to facilitate maneuvering of said jack stand and a jack operating handle retaining bale pivoted to said top brace plate for detachably holding the actuating handle of the associated jack in the stored position parallel to said jack stem.

14. The jack stand according to claim 7 which includes a handle extending from adjacent the upper ends of said vertical support posts to facilitate maneuvering of said jack stand and a jack operating handle retaining bale pivoted to said top brace plate for detachably holding the actuating handle of the associated jack in the stored position parallel to said jack stem.

15. The jack stand according to claim 12 which includes a handle extending from adjacent the upper ends of said vertical support posts to facilitate maneuvering of said jack stand and a jack operating handle retaining bale pivoted to said top brace plate for detachably holding the actuating handle of the associated jack in the stored position parallel to said jack stem.

16. A jack stand for jacks which include a base plate and a relatively long vertically extending jack stem, and an actuating handle for a jacking element movable up and down the stem; said jack stand comprising in combination a supporting base, means to stabilize said base, a pair of spaced and parallel support posts extending upwardly from said supporting base, an apertured top brace plate for detachably receiving the upper end portion of the stem of the associated jack and means to detachably clamp the base plate of the associated jack, to the supporting base, a handle extending from adjacent the upper ends of said vertical support posts to facilitate manoeuvering of said jack stand and a jack operating handle retaining bale pivoted to said top brace plate for detachably holding the actuating handle of the associated jack in the stored position parallel to said jack stem.

17. The jack stand according to claim 16 in which said supporting base is substantially rectangular when viewed in plan and includes a pair of wheels secured to adjacent a pair of adjacent corners of said support base, the axis of said wheels being spaced above said supporting base, with the periphery of the wheels being just above the underside of the supporting base.

18. The jack stand according to claim 17 which includes means to support said wheels for rotation, said means including a wheel support bracket secured by one end thereof to said supporting base and extending upwardly and outwardly therefrom.

19. The jack stand according to claim 16 in which said means to stabilize said supporting base includes a pair of support pads and means mounting said pads one upon each side of said supporting base and adjacent one end thereof, said last mentioned means extending diagonally outwardly from adjacent corners of one end thereby spacing said support pads outwardly and away from said supporting base, said pads lying substantially in the same plane as said support base.

20. The jack stand according to claim 17 in which said means to stabilize said supporting base includes a pair of support pads and means mounting said pads one upon each side of said supporting base and adjacent one end thereof, said last mentioned means extending diagonally outwardly from adjacent corners of one end thereby spacing :d support pads outwardly and away from said supporting base, said pads lying substantially in the same plane as said support base.

21. The jack stand according to claim 18 in which said means to stabilize said supporting base includes a pair of support pads and means mounting said pads one upon each side of said supporting base and adjacent one end thereof, said last mentioned means extending diagonally outwardly from adjacent corners of one end thereby spacing said support pads outwardly and away from said supporting base, said pads lying substantially in the same plane as said support base.

22. The jack stand according to claim 19 in which said means to stabilize said supporting base includes a pair of support pads and means mounting said pads one upon each side of said supporting base and adjacent one end thereof, said last mentioned means extending diagonally outwardly from adjacent corners of one end thereby spacing said support pads outwardly and away from said supporting base, said pads lying substantially in the same plane as said support base.

23. The jack stand according to claim 16 in which said apertured top brace plate is situated at an angle to the vertical to facilitate detachable engagement of the stem of the associated jack, through said aperture.

24. The jack stand according to claim 17 in which said apertured top brace plate is situated at an angle to the vertical to facilitate detachable engagement of the stem of the associated jack, through said aperture.

25. The jack stand according to claim 16 in which said means to detachably clamp the base plate of the associated jack to the supporting base includes a loose clamp bracket engaging over the base of the associated jack and being detachably secured to said supporting base and clamp means for clamping said clamp bracket to said supporting base.

26. The jack stand according to claim 19 in which said means to detachably clamp the base plate of the associated jack to the supporting base includes a loose clamp bracket engaging over the base of the associated jack and being detachably secured to said supporting base and clamp means for clamping said clamp bracket to said supporting base.

* * * * *